US006227944B1

(12) United States Patent
Xin et al.

(10) Patent No.: US 6,227,944 B1
(45) Date of Patent: May 8, 2001

(54) METHOD FOR PROCESSING A SEMICONDUCTOR WAFER

(75) Inventors: Yun-Biao Xin, St. Peters, MO (US); Ichiro Yoshimura, Tochigi (JP); Henry F. Erk, St. Louis, MO (US); Ralph V. Vogelgesang, Old Monroe, MO (US); Stephen Wayne Hensiek, Foley, MO (US)

(73) Assignee: MEMC Electronics Materials, Inc., St. Peters, MO (US)

( * ) Notice: Subject to any disclaimer, the term of this patent is extended or adjusted under 35 U.S.C. 154(b) by 0 days.

(21) Appl. No.: 09/276,278

(22) Filed: Mar. 25, 1999

(51) Int. Cl.[7] ..... B24B 1/00
(52) U.S. Cl. ..... 451/41; 438/693; 216/88
(58) Field of Search ..... 451/29, 41; 216/88, 216/90; 438/692, 693, 690, 691

(56) References Cited

U.S. PATENT DOCUMENTS

| | | | | |
|---|---|---|---|---|
| 4,232,059 | * | 11/1980 | Proffitt | 451/29 |
| 4,782,029 | | 11/1988 | Takemura et al. | 437/11 |
| 4,932,168 | | 6/1990 | Tada et al. | 51/436 |
| 5,389,579 | | 2/1995 | Wells | 437/225 |
| 5,508,206 | * | 4/1996 | Glenn et al. | 451/29 |
| 5,800,725 | * | 9/1998 | Kato et al. | 216/88 |

FOREIGN PATENT DOCUMENTS

| | | |
|---|---|---|
| 0791953A2 | 1/1987 | (EP) . |
| 0319805 | 6/1989 | (EP) . |
| 0783179A2 | 12/1996 | (EP) . |
| 61-239631 | 10/1986 | (JP) . |

OTHER PUBLICATIONS

IBM Technical dislosure Bulletin, E. Mendel, Dec. 1983, vol. 26 No. 7A.

International Search Report, Jul. 18, 2000.

* cited by examiner

*Primary Examiner*—M. Rachuba
(74) *Attorney, Agent, or Firm*—Senniger, Powers, Leavitt & Roedel

(57) ABSTRACT

A method for processing a semiconductor wafer sliced from a single-crystal ingot comprises subjecting the front and back surfaces of the wafer to a lapping operation to reduce the thickness of the wafer and to remove damage caused during slicing of the wafer. The wafer is then subjected to an etching operation to further reduce the thickness of the wafer and to further remove damage remaining after the lapping operation. The wafer is subsequently subjected to a double-side polishing operation to uniformly remove damage from the front and back surfaces caused by the lapping and etching operations, thereby improving the flatness of the wafer and leaving polished front and back surfaces. Finally, the back surface of the wafer is subjected to a back surface damaging operation in which damage is induced in the back surface of the wafer while the front surface is substantially protected against being damaged or roughened. A pressure jetting machine of the present invention includes a wafer holder that supports the wafer in the pressure jetting machine such that the back surface of the wafer is exposed to the jetted abrasive slurry while the front surface is supported by the holder in spaced relationship above a support surface of the machine to inhibit damaging engagement between the support surface and the front surface of the wafer.

14 Claims, 2 Drawing Sheets

METHOD FOR PROCESSING A SEMICONDUCTOR WAFER

BACKGROUND OF THE INVENTION

This invention relates generally to a method and pressure jetting machine for processing semiconductor wafers, and more specifically to a method and pressure jetting machine which improves the flatness of semiconductor wafers while providing a polished front surface and a damaged back surface suitable for inducing extrinsic gettering during subsequent processing of the wafer.

Semiconductor wafers are generally prepared from a single-crystal ingot, such as a silicon ingot, which is trimmed and ground to have one or more flats for proper orientation of the wafer in subsequent procedures. The ingot is then sliced into individual wafers which are each subjected to a number of wafer shaping or processing operations to reduce the thickness of the wafer, remove damage caused by the slicing operation, and to create a highly reflective surface.

In conventional wafer shaping processes, the peripheral edge of each wafer is first rounded, such as by an edge grinding operation, to reduce the risk of wafer damage during further processing. Next, a substantial amount of material is removed from the front and back surface of each wafer to remove surface damage induced by the slicing operation and to make the opposing front and back surfaces flat and parallel. This removal of material is accomplished by subjecting the front and back surfaces of the wafers to a conventional lapping operation (which uses a lapping slurry comprising abrasive particles), or a conventional grinding operation (which uses a disc with abrasive particles embedded therein), or even a combination of both lapping and grinding operations. The wafers are then etched by contacting each wafer with a chemical etchant to further reduce the thickness of the wafer and remove mechanical damage produced by the lapping and/or grinding operation.

Finally, the front surface of each wafer is polished, using a polishing pad and a polishing slurry comprising abrasive particles and a chemical etchant, to remove a small amount of material from the front surface of each wafer. The polishing operation removes damage induced by the etching operation and produces a highly reflective, damage-free front surface on each wafer.

In determining the quality of the processed semiconductor wafer, the flatness of the wafer is a critical parameter to customers since wafer flatness has a direct impact on the subsequent use and quality of semiconductor chips diced from the wafer. The flatness may be determined by a number of measuring methods. For example, "Taper" is a measurement of the lack of parallelism between the unpolished back surface and a selected focal plane of the wafer. "STIR", or Site Total Indicated Reading, is the difference between the highest point above the selected focal plane and the lowest point below the focal plane for a selected portion (e.g., 1 square cm.) of the wafer, and is always a positive number. "SFPD", or Site Focal Plane Deviation, is the highest point above, or the lowest point below, the chosen focal plane for a selected portion (e.g., 1 square cm.) of the wafer and may be a positive or negative number. "TTV", or Total Thickness Variation, which is frequently used to measure global flatness variation, is the difference between the maximum and minimum thicknesses of the wafer. TTV in the wafer is also an important indicator of the quality of the polish of the wafer.

With respect to wafer flatness, the conventional method of processing a semiconductor wafer described above has a number of disadvantages. For example, etching the wafer in an acid-based etchant generally deteriorates the flatness produced by the lapping or grinding operation. In addition, the flatness performance of the single-side polishing operation is inconsistent, depending primarily on the shape of the wafer being polished. The single-side polishing operation is a single-side planarization process, which limits its flattening capability.

In order to overcome this limitation and meet the demand for flatter wafers, a double-side polishing operation has become the polishing process of choice by wafer manufacturers. In a double-side polishing operation, the front and back surfaces of each wafer are polished simultaneously so that removal of material occurs uniformly on both sides of the wafer. Typically, equipment used for double-side polishing operations includes opposing rotating pads (one corresponding to each side of the wafer) that rotate in opposite directions while working the polishing slurry against the wafer. However, double-side polishing operations produce wafers generally having equally polished front and back surfaces, with little damage remaining on the back surface. This has been found to be undesirable to customers because of the lack of extrinsic gettering sites on the back surface of the wafers. Rather, these customers prefer wafers having a polished front surface and a back surface having subsurface damage to induce extrinsic gettering in subsequent processing operations.

Also, in conventional processes where the surfaces of the wafer are subjected to single-side polishing operations, the back surface of the wafer is subjected to a damaging operation before rapid thermal annealing (RTA) for thermal donor annihilation, if required, and before the single-side polishing. RTA tends to reduce the amount of damage previously induced in the back surface and also induces warp during the single-side polishing operation.

SUMMARY OF THE INVENTION

Among the several objects of this invention may be noted the provision of a method for processing semiconductor wafers which improves the flatness of the wafers; the provision of such a method in which the processed wafers each have a polished, generally damage-free front surface and a back surface sufficiently damaged for inducing extrinsic gettering of the wafers during subsequent processing of the wafers; and the provision of such a method which is simple to perform.

Among the further objects of this invention may be noted the provision of a pressure jetting machine which protects the front surface of the wafer while the back surface of the wafer is sufficiently damaged by pressure jetting for inducing extrinsic gettering of the wafers during subsequent processing of the wafer.

Generally, a method of the present invention for processing a semiconductor wafer sliced from a single-crystal ingot comprises subjecting the front and back surfaces of the wafer to a lapping operation to reduce the thickness of the wafer and to remove damage caused during slicing of the wafer. The wafer is then subjected to an etching operation in which the wafer is immersed in a chemical etchant to further reduce the thickness of the wafer and to further remove damage remaining after the lapping operation. The wafer is subsequently subjected to a double-side polishing operation in which material is concurrently and uniformly removed from the front and back surfaces of the wafer to uniformly remove damage caused by the lapping and etching operations, thereby improving the flatness of the wafer and leaving polished front and back surfaces. Finally, the back surface of the wafer is subjected to a back surface damaging operation in which damage is induced in the back surface of the wafer while the front surface is substantially protected against being damaged or roughened.

A device of the present invention for use in a pressure jetting machine of the type having a wafer support surface for supporting a wafer in the machine and a nozzle through which an abrasive slurry is jetted against the wafer to induce damage in at least one surface of the wafer generally comprises a wafer holder having an upper end and a lower end adapted for seating on the support surface of the pressure jetting machine. The wafer holder is configured for receiving a wafer therein and supporting the wafer in a generally horizontal orientation in spaced relationship above the support surface of the pressure jetting machine. One surface of the wafer faces upward and is exposed to abrasive slurry jetted from the nozzle and the other surface of the wafer faces downward and is supported by the wafer holder against damaging engagement with the support surface of the pressure jetting machine.

Other objects and features of the present invention will be in part apparent and in part pointed out hereinafter.

DESCRIPTION OF THE PREFERRED EMBODIMENT

It has been discovered that the several objects of the invention can be obtained by subjecting a semi-conductor wafer to a lapping or grinding operation and an etching operation in which the wafer is fully immersed in a chemical etchant, followed by a conventional double-side polishing operation to polish both the front and back surface of the wafers and improve flatness, and then a back surface damaging operation in which the back surface of the wafer is damaged while the front surface is protected against further damage or roughening. While the method of the present invention is illustrated and described herein with reference to semiconductor wafers constructed of silicon, it is understood that the method is applicable to processed wafers, discs or the like constructed of other materials without departing from the scope of this invention.

Figure 1:
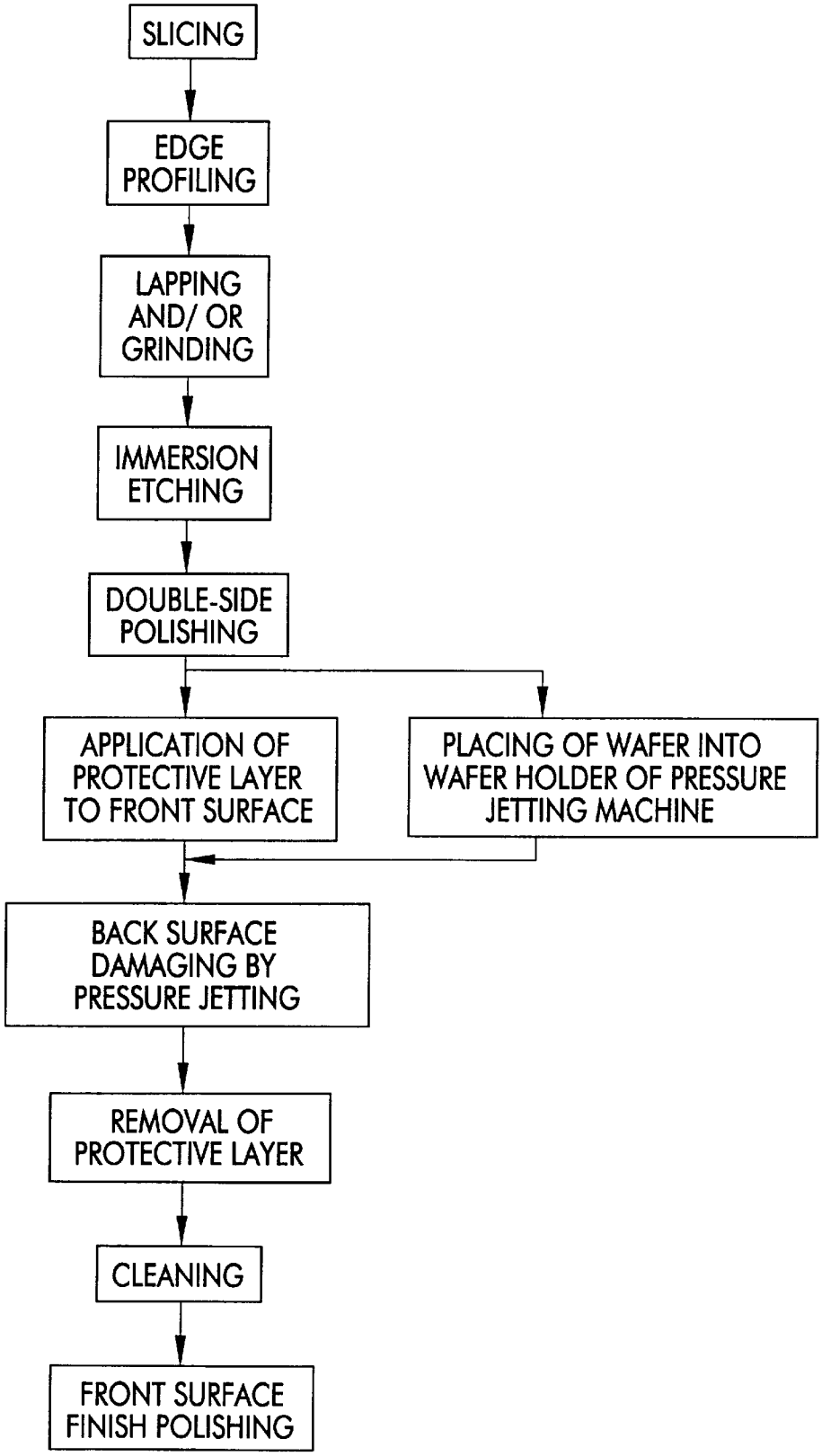
FIG. 1 is a flow diagram showing a first embodiment of a method of the present invention for manufacturing a semiconductor wafer.

FIG. 1 illustrates a preferred method of processing a semiconductor wafer according to the present invention. The semiconductor wafer is sliced from a single-crystal ingot, such as by using a conventional inner diameter saw or conventional wire saw, to have a predetermined initial thickness. The sliced wafer is generally disk-shaped, having a peripheral edge and opposing front and back surfaces. The initial thickness of each wafer is substantially greater than the desired end or final thickness to allow for the removal of wafer material from the front and back surfaces during subsequent processing operations without the risk of damaging or fracturing the wafer. After slicing, the wafer may be subjected to ultrasonic cleaning to remove particulate matter deposited on the wafer from the slicing operation. The peripheral edge of the wafer is then profiled (e.g., rounded) by a conventional edge grinder (not shown) to reduce the risk of damage to the wafer during further processing.

Next, the wafer is placed in a conventional lapping machine for removal of material from the front and back surfaces of the wafer using a lapping slurry containing abrasive particles. The lapping operation is used to substantially reduce the thickness of the wafer, thereby removing damage caused by the wafer slicing operation, and to flatten and parallel its front and back surfaces. As illustrated in FIG. 1, a conventional grinding operation, in which the front and back surfaces are ground using an abrading disc having abrasive particles embedded therein, may be performed in place of or in conjunction with the lapping operation. The wafer is then etched by being fully immersed in a chemical etchant, such as a conventional caustic etch solution comprising 45% (by weight) KOH or NaOH, to remove additional material from the front and back surfaces of the wafer and thereby reduce the damage caused during the prior processing operations. Those skilled in the art will recognize that subjecting the wafer to an immersion etching operation in an acid-based etchant tends to deteriorate the flatness of the wafer achieved during the lapping or grinding operation.

After immersion etching, the wafer is placed in a conventional double-side polishing machine (not shown) for concurrent polishing of the front and back surfaces of the wafer to remove damage caused by prior processing operations. One such. conventional machine is manufactured by Peter Wolters under the model designation Double-Side Polisher AC2000. The machine includes a rotating lower platen having a polishing surface defined by a polishing pad, and a carrier seated on the polishing pad that is rotatable relative to the rotating lower platen and polishing pad. Wafers are held in the carrier with a front surface of each wafer engaging the polishing pad. A second polishing pad facing opposite the front surface of the wafer is mounted on an upper platen. The upper platen is attached to a motor driven spindle that rotates the upper platen and polishing pad relative to the wafer carrier and the lower platen. The spindle is capable of being moved up and down along a vertical axis for moving the second polishing pad into polishing engagement with the back surface of the wafer whereby the wafer is sandwiched between the two polishing pads.

During the double-side polishing operation, a conventional polishing slurry containing abrasive particles and a chemical etchant is applied between the polishing pads and the wafer. One preferred polishing slurry is manufactured by DuPont of Wilmington, Del. under the tradename Syton HT50. The polishing pads work the slurry against the surfaces of the wafer to concurrently and uniformly remove material from the front and back surfaces of the wafer, thereby removing much of the damage caused by the lapping and etching operation, substantially improving the flatness of the wafer and producing polished front and back surfaces of the wafer.

Since damage has been removed from the back surface as well as the front surface, there is an undesirably low number of gettering sites on the back surface of the wafer. To this end, the back surface of the wafer is subjected to a back surface damaging operation in which the back surface of the wafer, but not the front surface, is damaged to provide gettering sites for extrinsic gettering of the wafer during subsequent processing operations. In a first embodiment shown in FIG. 1, the front surface of the wafer is masked with a protective layer and the wafer is placed in a pressure jetting machine in which the back surface of the wafer is subjected to a conventional pressure jetting operation to induce damage in the back surface of the wafer. One preferred method of masking the front surface of the wafer is to cover the surface with a protective tape. One such tape is manufactured by Minnesota Mining and Manufacturing Company of Minneapolis, Minn. under the model designation 3M495. As an example, the thickness of the tape is preferably in the range of 0.1–1 mm. The tape adheres to the front surface of the wafer and can be subsequently removed after the back surface damaging operation.

It is contemplated that conventional masking techniques other than taping may be used to provide a protective layer for the front surface of the wafer during the pressure jetting operation without departing from the scope of this invention. For example, a photo-resist film can be applied to the front surface. One such photo-resist film is manufactured by AZ Electronic Corp. under the model designation AZ1512. The thickness of the film is preferably in the range of about 0.1–0.5 mm. Alternatively, the front surface may be coated with a glass film. The surface is coated with glass material and the glass is allowed to cure on the surface. The glass is subsequently dissolved after the back surface damaging operation. One such glass material is manufactured by Dow Chemical of Midland, Mich. under the tradename Cyclotene. The thickness of the glass film is preferably in the range of about 0.1–1 mm.

The pressure jetting operation is performed by placing each wafer in a conventional pressure jetting machine (not shown). One preferred pressure jetting machine is manufactured by Mitsubishi Materials Corp. of Ikuro, Japan under the model designation C04. The wafer is placed on a moving belt (not shown but similar to the belt shown schematically in FIG. 3) of the jetting machine with the protected front surface of the wafer lying down against the belt and the back surface exposed and facing up. The wafer is moved through a chamber in which a slurry comprising a mixture of water and abrasive particles, is sprayed from a nozzle (not shown but similar to the nozzle shown schematically in FIG. 3) at a desired pressure toward the back surface of the wafer. The particles impact against the back surface of the wafer with sufficient force to induce damage in the back surface. The protective layer covering the front surface protects the front surface against damaging engagement with the belt of the pressure jetting machine as the jetting pressure pushes the wafer down against the belt. The abrasive particles in the jetting slurry are preferably alumina particles or silicon dioxide particles, both of which are available from Fujimi Co. of Japan. As an example, the particles are sized in the range of about 1–10 microns. The concentration of the particles within the slurry is approximately 0.5%–20% by weight. The abrasive slurry is pressurized to about 1–20 psi and is jetted against the back surface of the wafer for a duration of approximately 20–200 seconds.

After the back surface damaging operation, the protective layer is removed from the front surface of the wafer. For example, if the protective layer is protective tape, the tape is simply peeled from the wafer. If the protective layer is a photo-resist film, the film is dissolved by applying a chemical solvent to the film. A preferred solvent is manufactured by AZ Electronic Corp. under the tradename AZ S-L6 Stripper. A glass film is similarly dissolved by applying a chemical solvent to the film. A preferred solvent for dissolving the glass film is manufactured by Ashland Chemical, Inc. of Columbus, Ohio under the tradename HF. The wafer is then cleaned and finally the front surface of the wafer is subjected to a conventional finish polishing operation in which the wafer is placed in a single-side polishing machine and the front surface is polished using a conventional polishing slurry containing abrasive particles to produce a damage-free, highly reflective front surface of the wafer.

Figure 3:
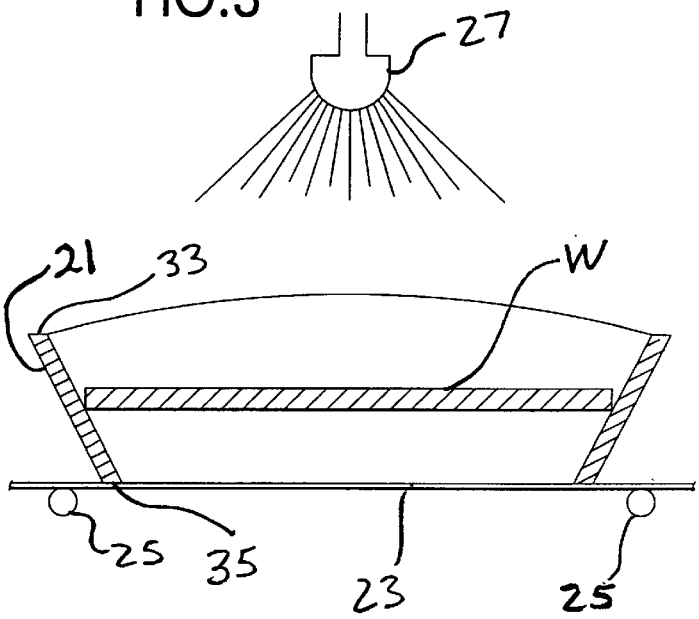
FIG. 3 is a schematic diagram showing a device of the present invention for use in a pressure jetting machine to support the wafer in the machine.

Still referring to FIG. 1, instead of applying a protective layer to the front surface of the wafer after the double-side polishing operation, the front surface may be protected during pressure jetting by supporting the wafer in spaced relationship above the belt (broadly, a "support surface" of the pressure jetting machine). This prevents damage to the front surface typically caused by the pressure of the jetted spray pushing the wafer down hard against the belt, thereby scratching and damaging the front surface. FIG. 3 schematically illustrates a preferred wafer holder 21 for holding a wafer W above a belt 23 of the pressure jetting machine during the pressure jetting operation. Particular elements of the pressure jetting machine, such as the belt 23 on rollers 25, and a spray nozzle 27 through which an abrasive slurry comprised of abrasive particles and deionized water is jetted, are schematically illustrated only for the purposes of describing the present invention. The structure and operation of pressure jetting machines is conventional and known to those skilled in the art and will not be further described herein except to the extent necessary to describe the wafer holder 21.

The wafer holder 21 is generally frusto-conical, having an upper end 33 and a lower end 35. The diameter of the lower end 35 of the wafer holder 21 is substantially less than the diameter of the wafer W to be supported by the wafer holder. The upper end 33 of the wafer holder 21 has a diameter substantially greater than the diameter of the wafer W for receiving the wafer into the holder. One or more slots (not shown) in the side of the wafer holder 21 extend down from the upper end 33 of the holder to permit easier insertion of the wafer W down into the holder and to permit draining of the slurry from the holder. The wafer holder 21 is preferably constructed of a material such as polyurethane or polypropylene (PP), polyvinyl chloride (PVC), polyvinylidene difluoride (PVDF), Polyphenylene sulfide (PPS), Cop-polymer polyvinyl chloride (CPVC) or Teflon or stainless steel. However, it is understood that the wafer holder 21 may be constructed of other materials without departing from the scope of this invention.

Still referring to FIG. 3, in operation the wafer holder 21 is placed on the belt 23 of the pressure jetting machine, with the lower end 35 of the wafer holder seated on the belt. The wafer W is lowered, either manually or robotically, down through the upper end 33 of the wafer holder 21, with the front surface of the wafer W facing downward, until the wafer seats within the holder in spaced relationship above the belt 23 and the lower end 35 of the wafer holder. During the pressure jetting operation, abrasive slurry jetted from the nozzle 27 impacts against the back surface of the wafer W to induce damage in the back surface. The wafer holder 21 protects the front surface of the wafer W by supporting the wafer above the belt 23, thereby preventing the pressurized spray from pushing the wafer down against the belt. As such, the front surface of the wafer cannot be scratched or otherwise damaged by contacting the belt.

Figure 2:
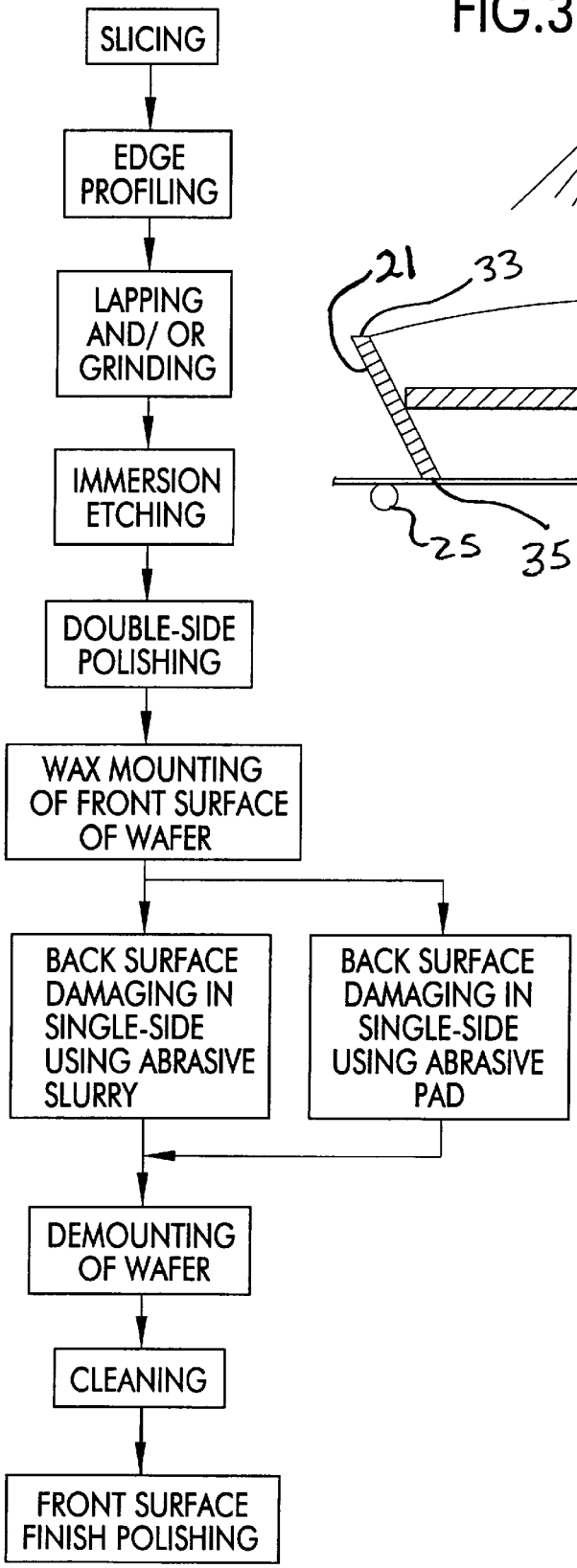
FIG. 2 is a flow diagram showing a second embodiment of a method of the present invention for manufacturing a semiconductor wafer.

FIG. 2 illustrates a second embodiment of the process of the present invention in which the back surface damaging operation is carried out by placing the wafer in a conventional single-side polishing machine. One preferred single-side polishing machine is manufactured by R. Howard Strasbaugh, Inc. under the model designation 6DZ. The wafer is mounted on a ceramic block by applying a wax layer to the block and adhering the front surface of the wafer to the block, thereby protecting the front surface against damage or roughening while leaving the back surface of the wafer exposed. The block is placed on a turntable of the machine with the back surface of the wafer contacting the polishing surface of a polishing pad. A polisher head is mounted on the machine and is capable of vertical movement along an axis extending through the ceramic block.

While the turntable rotates, the polisher head is moved against the ceramic block to urge the block toward the turntable, thereby pressing the back surface of the wafer into polishing engagement with the polishing surface of the polishing pad. An abrasive slurry containing abrasive particles and deionized water is applied between the polishing pad and the wafer. A preferred abrasive slurry is manufactured by Fujimi Co. of Japan under the model designation FO1200. The particles present in this slurry are alumina particles. However, it is understood that silicon dioxide particles, diamond particles or other suitable abrasive particles may be used instead of alumina particles without departing from the scope of this invention. The polishing pad works the slurry against the back surface of the wafer to induce damage in the back surface of the wafer. To induce the desired damage, the particles contained in the slurry must be substantially larger in size than particles contained in conventional polishing slurries used in single-side polishing operations. For example, the particles contained in the abrasive slurry for inducing damage are preferably in the range of about 1–10 microns. The concentration of particles in the abrasive slurry is preferably in the range of about 0.5–20% by weight.

In the embodiment illustrated in FIG. 2, an abrasive pad may be used in place of the polishing pad to eliminate the need for an abrasive slurry. One preferred such abrasive pad is manufactured by Minnesota Mining and Manufacturing Company of Minneapolis, Minn. under the designation 3M cerium oxide pad. The abrasive pad has raised ridges, preferably constructed of cerium oxide, integrally formed with the pad. In operation, the ceramic block is moved downward to urge the block toward the turntable, thereby pressing the back surface of the wafer into abrading engagement with the raised ridges of the abrasive pad to induce damage in the back surface of the wafer. Cooling water is applied between the abrasive pad and the wafer. The single-side polishing machine is preferably operated for a duration of about 20–200 seconds at an abrading pressure of less than about 2 psi.

After the back surface damaging operation, the wafer is de-mounted from the ceramic block and subjected to a conventional cleaning operation to clean the wafer. Finally, the front surface of the wafer is subjected to a conventional finish polishing operation to provide a damage-free, highly reflective front surface of the wafer.

EXAMPLE I

Approximately ten silicon semiconductor wafers, each having a diameter of about 8 inches, were processed according to the method illustrated in FIG. 2 and described above. More particularly, after the double-side polishing operation, the wafers were subjected to a back surface damaging operation in which the wafers were placed in the single-side polishing machine as described above. A 3M cerium oxide abrasive pad and water were used to induce damage in the back surfaces of the wafers. The single-side polishing machine was operated for a duration of 60 seconds at a polishing pressure of 1.7 psi. An Oxide-Induced Stacking Fault (OISF) count was taken for the back surface of one of the wafers. OISF is a measurement used to determine the likely effectiveness of subsequent extrinsic gettering. An OISF count in the range of 10,000–40,000 counts/cm$^2$ is typically desired by customers. The wafer analyzed after the back surface damaging operation had an OISF of about 29,700 counts/cm$^2$ which is within the desired range.

In view of the above, it will be seen that the several objects of the invention are achieved and other advantageous results attained. By double-side polishing the wafers after the immersion etching operation, the flatness of the wafers is substantially improved in comparison to the flatness of wafers processed according to conventional processes involving only single-side polishing. Subjecting the back surface of the wafer to a back surface damaging operation sufficiently damages the back surface for subsequent extrinsic gettering. By protecting the front surface of the wafer during the back surface damaging operation, whether by coating the front surface with a protective coating during a pressure jetting operation, supporting the wafer above the belt of the pressure jetting machine during a pressure jetting operation or wax mounting the front surface of the wafer to a ceramic block in a single-side polishing machine, the back surface damage is induced with little or no degradation of the flatness or polished characteristics of the front surface achieved by the double-side polishing operation.

As various changes could be made in the above methods without departing from the scope of the invention, it is intended that all matter contained in the above description or shown in the accompanying drawings shall be interpreted as illustrative and not in a limiting sense.

What is claimed is:

1. A method of processing a semiconductor wafer sliced from a single-crystal ingot and having front and back surfaces, said method comprising the steps, in order, of:

(a) subjecting the front and back surfaces of the wafer to a lapping operation to reduce the thickness of the wafer and to remove damage caused during slicing of the wafer;

(b) subjecting the wafer to an etching operation in which the wafer is immersed in a chemical etchant to further reduce the thickness of the wafer and to further remove damage remaining after the lapping operation;

(c) subjecting the wafer to a double-side polishing operation in which material is concurrently and uniformly removed from the front and back surfaces of the wafer to uniformly remove damage caused by the lapping and etching operations, thereby improving the flatness of the wafer and leaving polished front and back surfaces; and (d) subjecting the back surface of the wafer to a back surface damaging operation in which subsurface damage is induced in the back surface of the wafer to provide gettering sites for extrinsic gettering while the front surface is substantially protected against being damaged or roughened.

2. The method of claim 1 wherein the back surface damaging operation comprises the steps of:

(a) applying a protective layer to the front surface of the wafer;

(b) placing the wafer in a pressure jetting machine, with the back surface of the wafer exposed; and (c) operating the pressure jetting machine to jet a slurry containing abrasive particles against the back surface of the wafer, the impact of the particles against the back surface of the wafer inducing subsurface damage in the back surface of the wafer to provide gettering sites for extrinsic gettering, the protective layer applied to the front surface of the wafer substantially preventing damage or roughening of the front surface by the slurry.

3. The method of claim 2 wherein the protective layer is tape adhered to the front surface of the wafer.

4. The method of claim 2 wherein the protective layer is a photo-resist film.

5. The method of claim 2 wherein the protective layer is a glass film.

6. The method of claim 2 wherein the abrasive particles contained in the slurry are sized in the range of about 1–10 microns.

7. The method of claim 3 wherein the slurry contains alumina particles.

8. The method of claim 2 wherein the pressure jetting machine is operated at a pressure in the range of about 1–20 psi.

9. The method of claim 1 wherein the back surface damaging operation comprises the steps of:

(a) placing the wafer in a pressure jetting machine, with the back surface of the wafer exposed, the wafer being supported in the pressure jetting machine such that the front surface is substantially free of any engagement with the pressure jetting machine; and (b) operating the pressure jetting machine to jet a slurry containing abrasive particles against the back surface of the wafer, the impact of the particles against the back surface of the wafer inducing subsurface damage in the back surface of the wafer to provide gettering sites for extrinsic gettering, the supporting of the front surface such that the front surface is free of any engagement with the pressure jetting machine substantially preventing damage or roughening of the front surface by the slurry.

10. The method of claim 9 wherein the wafer is placed in a wafer holder disposed in the pressure jetting machine, the wafer holder being capable of supporting the wafer in spaced relationship above a support surface of the pressure jetting machine, said wafer holder being configured for supporting the wafer such that the back surface of the wafer faces upward and is exposed and the front surface of the wafer faces downward and is substantially free of engagement with the support surface of the pressure jetting machine.

11. The method of claim 1 wherein the back surface damaging operation comprises the steps of:

(a) wax mounting the front surface of the wafer on a block used in a single-side polishing machine;

(b) placing the block on a polishing pad of the single-side polishing machine with the back surface of the wafer being exposed and facing the polishing pad; and (c) operating the single-side polishing machine to abrade the back surface of the wafer, the front surface of the wafer being substantially protected by the wax layer and block against damage and roughening while subsurface damage is being induced in the back surface of the wafer to provide gettering sites for extrinsic gettering.

12. The method of claim 11 wherein the step of operating the single-side polishing machine to abrade the back surface of the wafer comprises applying an abrasive slurry between the polishing pad and the back surface of the wafer, the abrasive slurry containing abrasive particles sized for inducing subsurface damage in the back surface of the wafer to provide gettering sites for extrinsic gettering.

13. The method of claim 11 wherein the abrasive particles are sized in the range of about 1–10 microns.

14. The method of claim 11 wherein the polishing pad is an abrasive pad having raised ridges capable of inducing damage in the back surface of the wafer upon operation of the single-side polishing machine.

* * * * *